United States Patent [19]

Evans et al.

[11] 4,308,441

[45] Dec. 29, 1981

[54] HANDLE ASSEMBLY FOR MANUAL OPERATION OF ELECTRIC SWITCHES

[75] Inventors: David M. Evans, Palatine; Joel A. Ramos, Chicago, both of Ill.

[73] Assignee: S&C Electric Company, Chicago, Ill.

[21] Appl. No.: 93,091

[22] Filed: Nov. 9, 1979

[51] Int. Cl.[3] ..... H01H 25/00

[52] U.S. Cl. ..... 200/335; 200/48 KB; 200/337

[58] Field of Search ..... 200/335, 42 T, 153 R, 200/153 H, 329, 337, 48 KB, 162

[56] References Cited

U.S. PATENT DOCUMENTS

| | | | |
|---|---|---|---|
| 1,928,487 | 9/1933 | Hammerly | 200/337 |
| 2,234,563 | 3/1941 | Kneass | 200/162 |
| 3,028,459 | 4/1962 | Norden | 200/337 |
| 3,141,947 | 7/1964 | Daly et al. | 200/337 |

*Primary Examiner*—Willis Little

*Attorney, Agent, or Firm*—John D. Kaufmann

[57] ABSTRACT

A manual operating handle assembly for an enclosed switch includes a walled frame which resides within the switch enclosure and rotatably mounts a shaft. A sprocket on the shaft turns therewith to move a chain coupled to another sprocket which operates the switch or a stored-energy operator therefor. A pair of arms keyed to the shaft mounts a handle for longitudinal sliding movement toward the shaft and into the frame, and away from the shaft and out of the frame. Rotation of the handle between extreme rotative locations rotates the arms and the shaft. A contoured surface within the frame interferes with the handle in its extreme rotative locations when it is within the frame to prevent rotation thereof. Only if the handle is first slid out of the frame does it clear the surface for rotation between its extreme rotative locations. When the handle is between its extreme rotative locations, it cannot be slid into the frame due to interference of the contoured surface. The handle may be locked when it is in either extreme rotative location and within the frame, whereat it presents a low profile, is shielded from the elements, and is virtually pryproof and vandal-proof.

22 Claims, 11 Drawing Figures

HANDLE ASSEMBLY FOR MANUAL OPERATION OF ELECTRIC SWITCHES

BACKGROUND OF THE INVENTION

1. Field of the Invention

This invention relates to a handle assembly for manual operation of electric switches, and more particularly to an operator-manipulable handle assembly for manually operating high-voltage switches which is easy to use and convenient to manufacture, which requires the application of only reasonable force, and which is virtually tamper-proof and prevents unauthorized operation of the switches.

2. Description of the Prior Art

High-voltage switches and switchgear containing such switches of various types are well known. High-voltage switchgear, for the purposes of the present invention, may be generally described as including one or more high-voltage switches contained within a metal enclosure. Each switch within the enclosure may have connected in electrical series therewith a high-voltage fuse or other protective device. The switches themselves are typically interrupting switches, but may be other types. Interrupting switches have the capability of interrupting magnetizing or normal load currents upon the opening thereof and may, at times, have fault closing ratings, that is, the ability to close while a fault condition exists.

In general, a high-voltage switch includes one or more stationary contacts, and a movable contact or blade. The switch is closed when the blade engages the stationary contacts and is open when the blade is disengaged from the stationary contacts. The blade may move in a rotative fashion and, if more than one switch is present within the enclosure, the blades of all switches may be simultaneously rotated between the open and closed positions by the rotation of a common drive member or strut to which all of the blades are attached. The switch blade may also be reciprocable, that is, linearly movable toward and away from the stationary contacts.

A wide variety of manual operating handles to operate high-voltage switches are well known. Such handles are often rotatable from the exterior of the enclosure in order to operate the switches. In this way, the switches may be operated without the need for entering the enclosure. After the operation of the switches within the enclosure; i.e., after the switches are either fully opened or fully closed, it is usually desired that the handle have the capability of being locked. Locking prevents the unauthorized operation of the switches. Also, it is often desired that the handle or switches be selectively immobilized by a so-called key interlock. Such an interlock can be manipulated to free the handle and switches for movement only when its key is present therein. The key is available for this purpose only if other apparatus (other switches, etc.) is in some selected condition which releases the key. This ensures that the switches and the other apparatus are operated in an appropriate sequence and have appropriate relative conditions.

Often, the switches are not operated directly by rotation of the handle. Rather, it is often desirable to provide a stored-energy mechanism, the condition of which is affected by rotation of the handle. The stored-energy mechanism operates the switches rapidly in a manner not dependent upon the speed of rotation of the handle. These stored-energy operating mechanisms often require a high degree of mechanical effort to store energy therein. Thus, in addition to its ability to be locked in the positions it occupies when the switches are fully opened or fully closed, an operating handle must usually have a substantial length so that only a reasonable amount of force is required to rotate the handle, thus operating the stored-energy mechanism and the switches.

Typical operating handles, until now, have usually included rotative handle members external of the enclosure, the majority of the handle being fully exposed to the elements at all times unless covers or the like are provided. It would be desirable to provide an operating handle, the parts of which are not fully, directly exposed to the elements. Further, known exposed handles usually have unsightly "high profiles," i.e., they protrude substantially away from the surface of the enclosure even when locked. This leads to covers for such handles also having high profiles and, if covers are not used, permits unauthorized persons or vandals to apply prying forces to the handles which may lead to improper and unauthorized operation of the switches. It is a desirable goal to provide a "low profile" handle which does not protrude from the enclosure in an unsightly manner and to which prying forces cannot be applied in an attempt to operate the switches without authorization.

Accordingly, a primary object of the present invention is to provide an improved operating handle assembly for apparatus, such as electric switches, which may be locked when the switches are fully closed to prevent unauthorized operation thereof, which has a length sufficient to require only the application of reasonable force in order to operate the switches, which is not fully directly exposed to the elements, which may conveniently be associated with a key interlock, which has a low profile, and which is convenient to manufacture.

SUMMARY OF THE INVENTION

In its broadest aspects, the present invention relates to an assembly for manual operation of apparatus. The assembly includes a rotatable shaft and facilities thereon for operating the apparatus when the shaft rotates. A rotatable handle rotates the shaft and is mounted to the shaft for longitudinal movement toward and away from the shaft between to extreme positions. A control facility prevents rotation of the handle when it is in one of the extreme longitudinal positions but permits such rotation when it is in the other extreme longitudinal position. In preferred forms of the broadest aspects of the present invention the control facility prevents rotation of the handle when it is between the extreme longitudinal positions. Further, the handle may be rotatable between two extreme locations and the control facility may prevent longitudinal movement of the handle toward the one extreme longitudinal position when it is between the extreme rotative locations. The control facility may be a cam surface shaped so as to selectively interfere with handle movement—longitudinal or rotative—to achieve the above-described functions. Also, the apparatus may reside within an enclosure, in which event, in its one extreme longitudinal position most of the handle is within the enclosure—and presents a low profile—and in the other extreme longitudinal position most of the handle is outside the enclosure. Facilities, such as the walls of a frame within the enclosure, and into and out of which frame the handle is longitudinally movable, prevent the efficient application of rotative and longitudinal forces to the handle when it is in the one extreme longitudinal position. Lastly, the handle may include a hand-graspable member which is outside the enclosure (and frame)—and, thus, accessible—in all rotative locations and longitudinal positions of the handle. The effective lever arm between the member and the shaft when the handle is in its other longitudinal position—withdrawn from the enclosure and capable of rotating—is such that only reasonable manual force need be applied to the member to operate the apparatus.

According to the specific, preferred embodiments of the present invention, the handle assembly operates high-voltage switches. An arm is rotably mounted by the shaft between opposed walls of the frame. Connected to the shaft are facilities rotatable therewith which, in response to shaft rotation, either directly operate the switch or operate a stored-energy operating mechanism which in turn operates the switch. The handle is slideably mounted to the arm for longitudinal movement toward and away from the shaft. Abutment of the handle and the frame may define the extreme rotative locations. Typically, the cam surface is positioned between the opposed frame walls and generally describes a convexity when viewed from the member on the handle. The cam surface typically includes an apex and surfaces sloping down and away from the apex. These surfaces interfere with the handle when it is both substantially within the frame and in either of its extreme rotative locations. The apex interferes with the handle when it is substantially without the frame and is also between its extreme rotative locations.

DETAILED DESCRIPTION OF THE INVENTION

Figure 1:
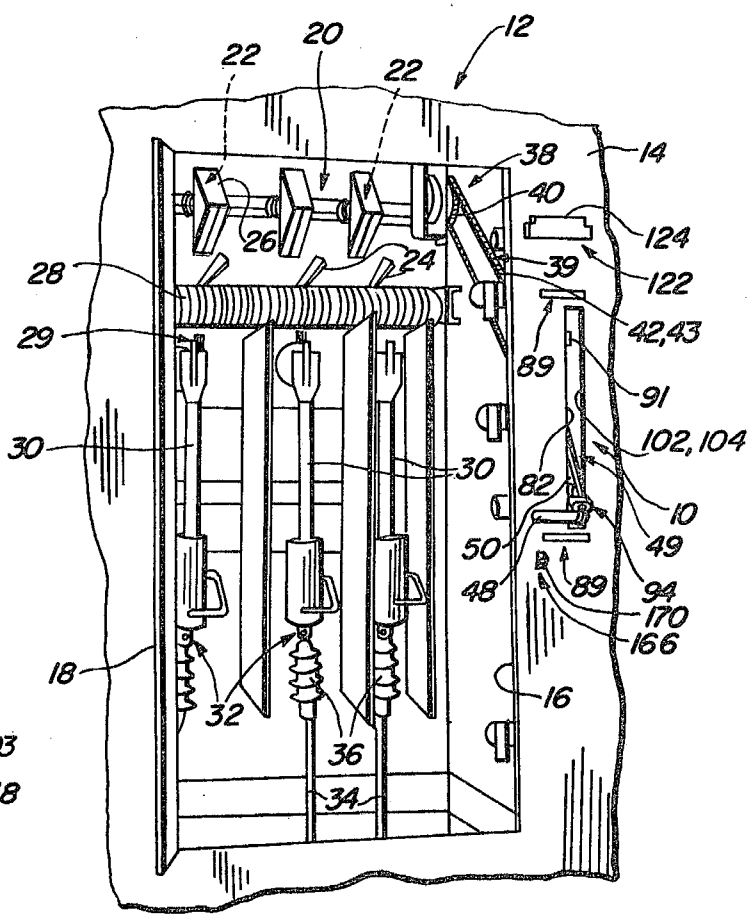
FIG. 1 is a perspective, front view of high-voltage switchgear which includes switches operated by a manual handle assembly in accordance with the principles of the present invention.

Referring to FIG. 1, the handle assembly 10 of the present invention is disclosed in conjunction with a particular type of high-voltage switchgear 12. It should be understood that the handle assembly 10 may be used with other types of high-voltage switchgear as well as with other apparatus, as should be obvious from the following description.

The high-voltage switchgear 12 is contained within a metal enclosure 14 which has an opening 16 therethrough normally closed by a door 18 (shown open in FIG. 1). In typical arrangements, the door 18 is opened only when it is desired to gain access to the components of the switchgear 12 through the opening 16.

The circuit to which the switchgear 12 is connected may be a three-phase circuit. Accordingly, the components of the switchgear 12 include a three-phase switch 20 within the enclosure 14. The three-phase switch 20 includes three switch poles, each pole comprising one or more stationary contacts, shown only generally at 22, and a movable contact or switch blade 24. In the particular type of switchgear 12 depicted, the contacts 22 are normally within arc-compression chutes 26 which permit the switch blades 24, which normally engage the stationary contacts 22, to be moved away therefrom (opened, as shown in FIG. 1) for extinguishing the high-voltage arc which forms and to interrupt current in the circuit. The switch blades 24 may each be mounted to an insulative strut 28 which is journaled for rotation within the enclosure 14 by structure not shown. As viewed in FIG. 1, rotation of the strut 28 in a direction into the plane of the Figure closes the switch 20, that is, engages the blades 24 with the stationary contacts 22, while opposite rotation of the strut 28 opens the switch 20 by disengaging or separating the blades 24 from the stationary contacts 22. Switches like the switch 20 are shown in the following commonly assigned U.S. Patents and applications: U.S. Pat. Nos. 3,980,977; 3,549,840; 3,576,967; 3,671,697; 3,676,629; and Ser. No. 956,463, filed Oct. 30, 1978. The switch 20 may be of the reciprocating type (not shown) in which the blades 24 move linearly into and out of engagement with the stationary contacts 22.

Each switch blade 24 may be continuously, electrically connected by sliding contacts 29 to the top of a high-voltage, disconnect or other type of fuse 30. The bottom of each fuse 30 is electrically connected to a terminal, generally depicted at 32, which in turn is connectable to high-voltage conductors 34 via terminators 36. The stationary contacts 22 are similarly connectible to conductors (not shown).

The switchgear 12 may include a stored-energy operator, generally depicted at 38. The stored-energy operator 38 is of the type which may store energy therein to both open and close the switch 20 so that the movement of the switch blades 24 is not dependent upon the speed of the physical actions of a human operator. The stored-energy operator 38 can store energy therein both for opening and closing the switch 20 due to manipulation of the handle assembly 10. The handle assembly 10 may be connected to the stored-energy operator 38 by means of a chain assembly 39 which meshes with a sprocket 40 associated with the stored-energy operator 38 and a sprocket 41 (FIG. 2) driven by the handle assembly 10.

The stored-energy operator 38 need not be used; operation of the handle assembly 10 may directly operate the switch 20, as for example, by directly rotating a sprocket, similar to the sprocket 40, which is directly coupled to the strut 28 or other operating member for the blades 24. The stored-energy operator 38 is desirable because it renders operation of the switch 20 independent of the speed at which, and the manner in which, the assembly 10 is manipulated by a human operator. Such operators 38 are disclosed in the following commonly assigned U.S. Patents and applications: U.S. Pat. Nos. 3,898,420; 2,954,450; 3,563,102; 3,980,977; Ser. No. 26,867, filed Apr. 4, 1969; and Ser. No. 911,123, filed May 31, 1978.

Storage of energy in the operator 38 involves high tensile forces in one or the other of the runs 39*a* or 39*b* of the chain assembly 39. In order to maintain the sprockets 40 and 41, a constant distance apart notwithstanding such tensile forces—and also to prevent the chain assembly 39 from becoming so slack that it disengages the sprockets 40 and 41—compression members 42 and 43 (See FIG. 2) may be interposed between the switch 20 and the handle assembly 10. The total length of the compression members 42 and 43 may be adjustable via elongated holes 44 in one of the members 42 and aligned holes 45 in the other member 43. Bolts 46 through the holes 44 and 45 rigidly lock the members 42 and 43 together. The member 42 may have a bore (not shown) one end which surrounds a shaft common to the sprocket 40. The member 43 may be attached to the enclosure 14 or to a frame 47 (FIG. 2) for the handle assembly 10.

Figure 3:
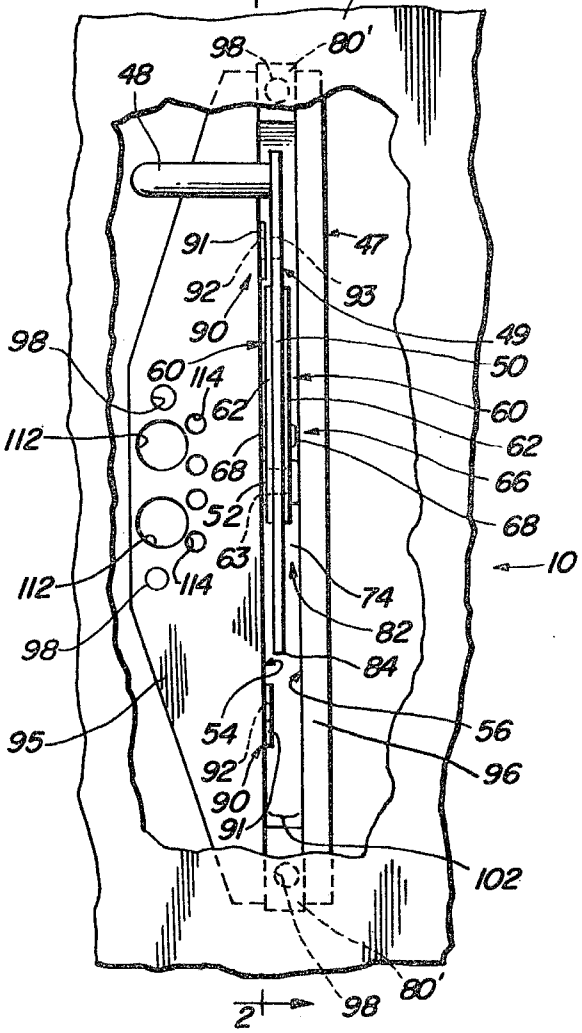
FIG. 3 is a detailed, front elevation of the handle assembly of FIG. 2.
Figure 2:
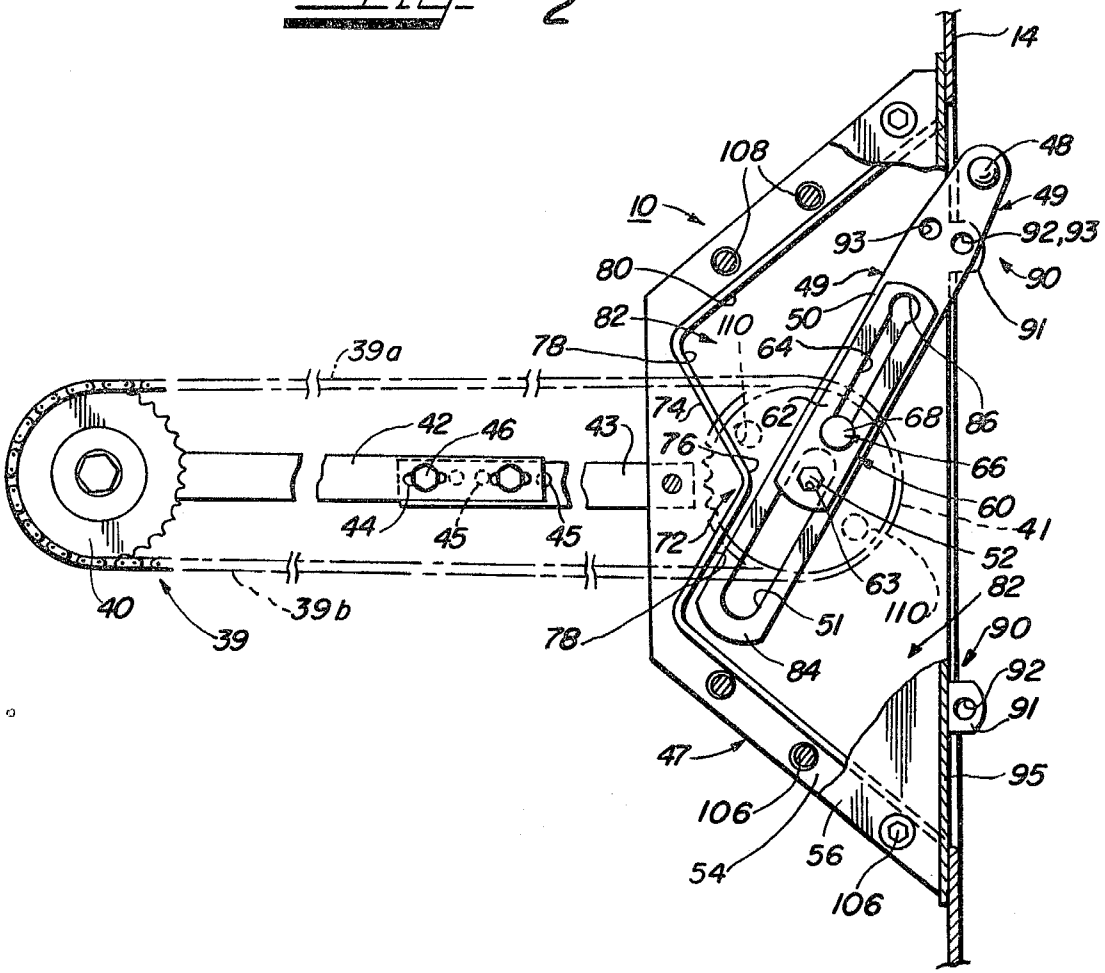
FIG. 2 is a partially sectioned, side elevation of the handle assembly of FIG. 1 and of portions of the switchgear associated therewith taken along line 2—2 in FIG. 3.

Referring now especially to FIGS. 2 and 3, the handle assembly 10 includes a manually grippable and manipulable member such as a bar 48. Manipulation of the bar 48 by an operator effects movement of the handle assembly 10 to store energy in the stored-energy operator 38 which, in turn, effects operation of the switch 20. The bar 48 is attached to one end of a handle 49 which may comprise an elongated member 50 having a slot 51 formed therethrough. The slot 51 acts as a way which surrounds, and permits the member 50 to slide or longitudinally move relative to, a shaft 52. Such longitudinal or sliding movement of the member 50 is limited by the length of the slot or way 51.

The shaft 52 is journaled for rotation in opposed walls 54 and 56 of the walled frame generally designated at 47. The shaft 52 may have a hexagonal or other polygonal cross section between the walls 54 and 56. Mounted to the shaft 52 for rotation therewith, are a pair of arms 60 which act as a unitary arm. The arms 60 constitute elongated members 62 fastened to the shaft 52 in any convenient fashion as, for example, by keying hexagonal holes 63 therein to the hexagonal periphery of the shaft 52. The members 62 contain slots or ways 64 therein. Extending from both sides of the member 50 is a headed pin 66, the body of which rides in the slots or ways 64. The attachment of the members 62 to the shaft 52 and the presence of the pin 66 in the slots or ways 64 maintains the members 62 at all times generally parallel to the member 50. Heads 68 of the pin 66 prevent the members 62 from moving laterally away from the member 50.

Mounted to the shaft 52, preferably on the outside of the frame 47 is the sprocket 41 around which a portion of the chain assembly 39 passes. Rotation of the sprocket 41 tensions one run 39*a* or 39*b* of the chain 39 to rotate the sprocket 40 for storing energy in the stored-energy operator 38 to operate the switch 20. The sprocket 40 rotates the stored-energy operator 38 to operate the switch 20. The sprocket 41 rotates with the shaft 52. The shaft 52 rotates as the handle 49 and its member 50 rotate due to the presence of the pin 66 in the slot or way 64 and the keying of the members 62 to the shaft 52. Thus, should it be desired to operate the switch 20, an operator grips the bar 48 to rotate the handle 49, thereby rotating its elongated member 50. The pin 66 applies rotative force to the members 62 of the arms 60, which in turn rotate the shaft 52 to rotate the sprocket 41.

Mounted between opposed walls 54 and 56 is a control facility 72 which includes a contoured member or cam surface 74. In the specific embodiment depicted, the contoured member 74 assumes the shape of a "W". Specifically, the contoured member 74 comprises an apex 76 and a pair of surfaces 78 which slope back away from the apex 76 as viewed in FIG. 3. The surfaces 78 terminate in portions 80 which may run outwardly, as viewed in FIG. 3, to the front of the walls 54 and 56. The walls 54 and 56 and the control facility 72 define a volume 82 within the walled frame 47.

Figure 4C:
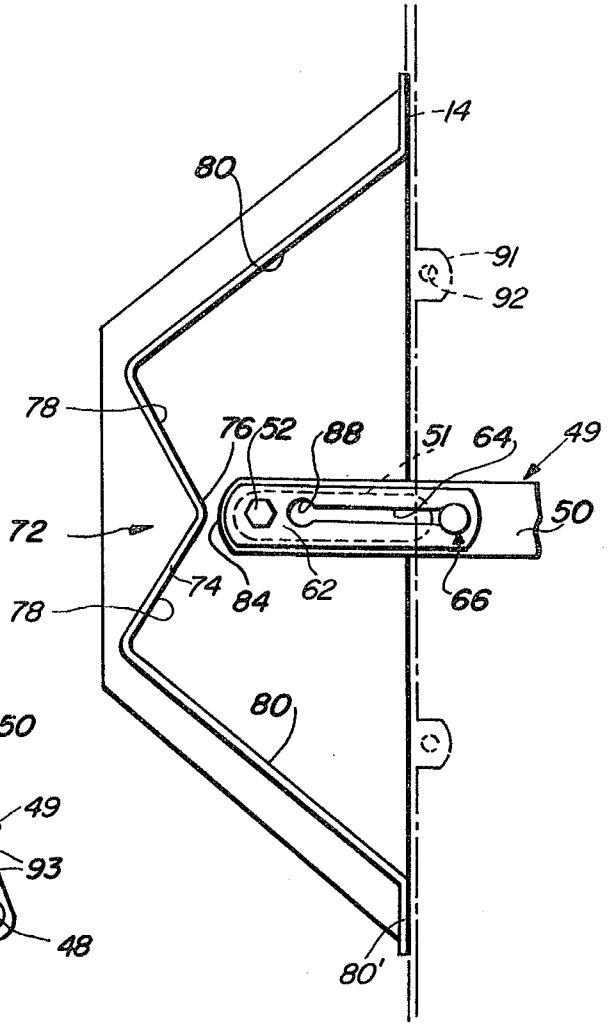
FIGS. 4A–4C illustrates various positions of the handle assembly of FIGS. 1–3.
Figure 4B:
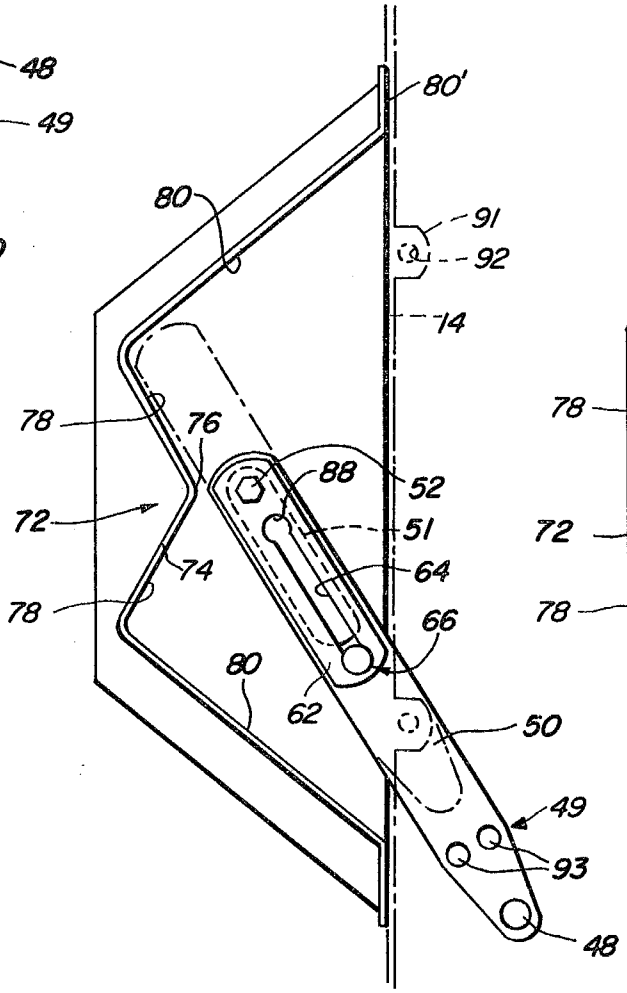
Figure 4A:
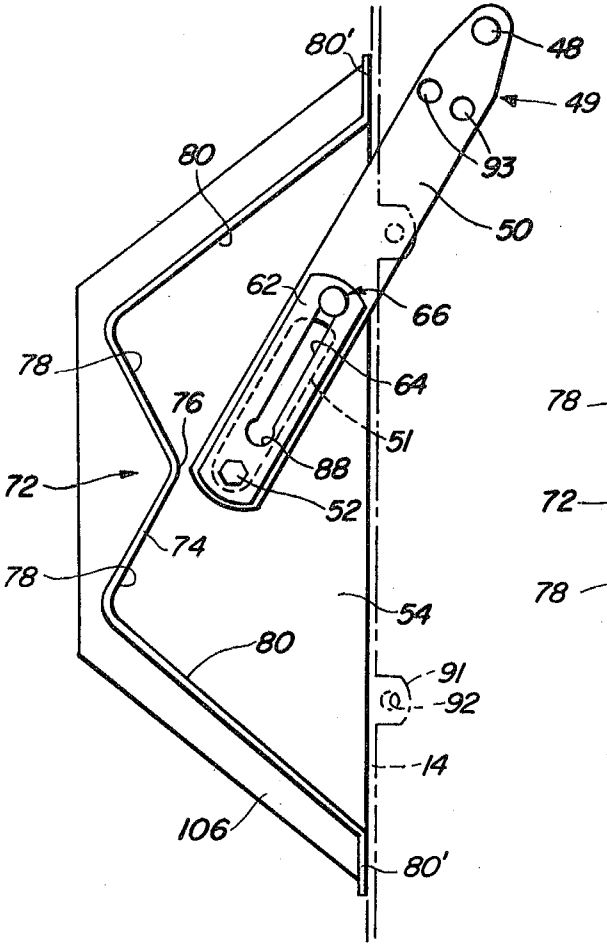

As viewed in FIG. 2, if the handle 49 and its member 50 assume the extreme inward longitudinal position shown, neither the handle 49, the arms 60, nor the shaft 52 may be rotated. Specifically, one end 84 of the member 50 is prevented from rotating due to the interference therewith by the lower surface 78 of the contoured member 74. In order to rotate the handle 49 from the upward location shown in FIG. 2 to a location where the bar 48 is at the bottom of the walled frame 47, the operator must first grasp the bar 48 and pull the elongated handle 49 and its member 50 longitudinally outwardly away from the shaft 52 and out of the volume 82. Such longitudinal movement of the handle 49 is permitted due to the presence of the slot 51 which slides relative to the shaft 52 and the pin 66 which slides in the slot 64. The lengths of the slots 51 and 64 are such that, only in the extreme outward longitudinal position of the handle 49 when the shaft 52 abuts the lower end of the slot 51 and the pin 66 abuts the upper end of the slot 64, does the end 84 of the member 50 clear the surface 78 and the apex 76 of the contoured member 74 (shown in FIG. 4A). In this condition, the handle 49 may be rotated from top to bottom, rotating the arms 60, the shaft 52, and the sprocket 41 to store energy in the stored-energy operating mechanism 38 for operating the switch 20 (shown in solid lines in FIG. 4B). Once the handle 49 and the bar 48 are located at the lower end of the walled frame 47, the operator may manipulate the bar 48 to push the handle 49 and its member 50 inwardly of the frame 47 to the extreme inward position (shown in phantom in FIG. 4B). Such action causes the end 84 of the member 50 to be interfered with by the upper surface 78 of the contoured member 74 so that rotation of the handle 49 from the lever location back to the upper location depicted in FIG. 2 cannot be effected unless the handle 49 and its member 50 are again extracted from the volume 82 by pulling these members outwardly relative to the shaft 52 to the extreme outward longitudinal position.

It should be noted that, if the handle 49 is anywhere between its extreme upper and lower rotational locations, the handle 49 and its member 50 may not be pushed back into the volume 82 of the frame 47. Specifically, whenever the handle 49 is being rotated, either upwardly or downwardly, the apex 76 of the contoured member 74 interferes with the end 84 of the member 50 (shown in FIG. 4C). This interference prevents the handle 49 and the member 50 from being reinserted back into the volume 82 of the frame 47 unless the handle 49 is in one of its two extreme rotative locations. Thus, unless the handle 49 resides in one of such extreme rotative locations, its longitudinal position relative to the frame 47 can only be outward. By the same token, if the handle 49 is at one of its two extreme rotative locations and is in the full inward longitudinal position, it cannot be rotated until it is moved fully outwardly.

The slots 64 formed in the members 62 may be enlarged at either end as shown at 86 and 88. These enlargements 86 and 88 permit a slight amount of relative rotation between the members 62 and the member 50 when the pin 66 is positioned at either end of the slots 64. Two ends are achieved by the interaction between the pin 66 and the enlargements 86 and 88. First, when the switch 20 has been operated and the handle 49 is both down as viewed in FIG. 4B, and in its full inward position, (in phantom) the mass of the handle 49 slightly rotates the member 50 relative to the members 62. This, in turn, causes the pin 66 to engage the bottoms of the enlargements 88 slightly off the center line of the slots 64. This engagement is detent-like and resists sliding of the handle 49 to its full outward position. Second, as the switch 20 is being operated while the handle 49 is in its full outward position, the force exerted on the bar 48 causes the pin 66 to engage the bottoms or tops of the enlargements 86 slightly off the center line of the slots 64. This detent-like engagement resists inward movement of the handle 49 (and supplements the action of the apex 76 in this regard) to ensure that a sufficient lever arm exists between the bar 48 and the shaft 52 so that only reasonable amounts of force are required to rotate the handle 49.

The size of the sprockets 40 and 41 and other dimensions may be selected so that the switch 20 is fully open or closed prior to the bar 48 abutting the enclosure 14, as should be obvious. This prevents injury to the hand of an operator. Further, the extreme rotative locations of the handle 49 may be set by abutting interference between the member 50 and the termini 80' of the portions 80 of the contoured member 74. Labels 89 indicating "open" or "closed" may be placed on the enclosure 14 adjacent the appropriate rotative locations assumed by the handle 49 (See FIG. 1).

Although the frame 74 need not be used—the shaft 52 may be journaled elsewhere and the contoured member 74 may be mounted within the enclosure 14—its presence is preferred. Specifically, because the volume 82 defined by the walls 54 and 56 and the contoured member 74 is closed, no wires, sticks or the like may be inserted therethrough into the interior of the enclosure 14.

The frame 47 may include facilities 90 for locking the handle 49 when it is one of its two extreme rotative locations and has been pushed to its full inward position within the volume 82 defined by the frame 47. Specifically, included on the wall 54 may be a pair of tabs 91, each containing a hole 92 therethrough. The member 50 of the handle 49 also contains one or more holes 93. When the handle 49 is in one of its two extreme rotative locations (and nowhere else, which mitigates against "partial" operation of the switch 20) and is in its full inward longitudinal position, one of the holes 93 aligns with one of the holes 92 in one of the tabs 91. In this position of the handle 49, a member such as the shackle of a padlock 94 (FIG. 1) may be inserted through the aligned holes 92, 93 and locked to prevent unauthorized movement of the handle 49. With the handle 49 thus inwardly held immobile, prying thereof by vandals or other unauthorized persons is prevented. Specifically, the member 50 is essentially inaccessible to a prying instrument due to its insertion into the volume 82 and the proximity of the walls 54 and 56 (See FIG. 3.) Only the bar 48 is accessible for prying and this only in a direction longitudinal of the handle 49 because of the interference therewith by the contoured member 74. Thus, successful prying requires shearing of the lock shackle in the holes 92 and 93, such shearing being quite difficult to achieve.

As a result of the insertion-proof nature of the volume 82 and the pry-proof nature of the handle 49, the handle assembly 10 is virtually tamper- and vandal-proof.

The handle assembly 10 may be fabricated as an integral unit for attachment as such to the enclosure 14 of the switchgear 12. To this end, the wall 54 may include a flange 95, and the wall 56 may include a flange 96. The flange 95 may contain appropriate holes 98, as may the termini 80' of the portions 80 of the contoured member 74, for mounting the handle assembly 10 to the inside of the front wall of the enclosure 14. Such mounting may be effected via bolts (not shown) weldments or other attachments to the interior of the enclosure 14 which are not accessible from the exterior thereof. A slit or space 102 defined by the walls 54 and 56 may be aligned with a similar slit 104 (FIG. 1) formed through the enclosure 14. The walls 54 and 56 may be held together by an appropriate number of fasteners, such as bolts 106 which pass through aligned holes 108 formed through the walls 54 and 56.

Thus, it may be seen that the handle 49 may not be rotated in its full extreme inward, longitudinal position, but may be rotated only if it is longitudinally slid relative to the arm 60 to its extreme outward position. In this latter position, the handle 49 may be rotated between its extreme rotative locations to operate the switch 20. The amount of rotation of the handle 49 is limited in preferred embodiments to about 120°. The handle 49 may not be moved from its outward longitudinal position to its inward longitudinal position any time it is between its extreme rotative locations due to interference between the end 84 of the member 50 and the apex 76 of the contoured member 74.

As viewed in FIG. 2, the control facility 72 is a contoured member 74 which has the shape of a "W", or, focusing on the apex 76 and the surfaces 78, of a triangle. Other contoured members 74 may clearly be used. The contoured member 74 is preferably generally convex as viewed from the end of the handle 49 adjacent the bar 48, but may be truncated, rounded or otherwise altered in shape. Also preferably, the surface 74 inferes with rotation of the handle 49 at least until it is withdrawn sufficiently to require no more than a reasonable force on the bar 48 to operate the switch 20 and the operator 38.

Other facilities for locking the handle assembly 10 may be provided in addition to the locking facilities 90. For example, the sprocket 41 may contain two diametrically opposed holes 110. Key interlock facilities (not shown) on the outside of the enclosure 14 may have a bolt thereof in one of the holes 110 to prevent rotation of the sprocket 41. Manipulation of the key interlock as described earlier, removes the bolt from the hole 110 to free the sprocket 41 for rotation. The holes 110 are selectively located to permit entry of the bolt only when the switch 20 is fully open or closed. If sale of the handle assembly 10 apart from the switchgear 12 is contemplated, the flange 95 may contain holes 112 through which the body of the interlock is to extend and holes 114 for fixing the interlock to the flange 95. The holes 112 and 114 provide a mount for the interlock as well as a template for formation of holes for the interlock in the enclosure 14. Use of interlocks has the advantage of locking the drive train (the sprockets 40 and 41 and the chain assembly 39) in the event the padlock 94 locking the handle 49 is successfully removed by an interloper.

When the handle 49 is in its full inward position it presents a low profile relative to the enclosure 14, and is both protected against environmental effects and rendered pry-proof by its presence in the volume 82. This low profile—only the bar 48 and the very end of the member 50 are outside the volume 82, See FIG. 2—permits convenient use of a low-profile cover assembly 120 should further vandal-proofing of environmental protection be desired.

Referring to FIGS. 1 and 7, the low-profile cover assembly 120 is seen to include a bracket 122 having an upwardly extending plate 124 with a free upper edge. The bracket 122 is mounted to the enclosure 14 in any convenient manner above the slits 102 and 104. A cover 126 includes a cover catch 128 having a depending lip 130 with vertical and horizontal dimensions substantially the same as those of the free edge of the plate 124. The cover 126 includes a main body 132 to the top of which the catch 128 is attached as convenient. The main body 132 is formed to define an interior cavity 134 having a sufficient depth to permit the main body 132 to clear the bar 48 when placed over the inwardly positioned handle 49 and a width sufficient to clear the bar 45 and the padlock 94 locking the handle 46. The body 132 also defines an exterior cavity 136 for a purpose described shortly. The exterior cavity 136 is intended to reside below and clear the bar 48 when the handle 49 is rotated down (as seen in FIG. 1); thus the body 132 is somewhat longer than the slits 102 and 104. The periphery of the interior cavity 134 may be rimmed with a flexible gasket 138 fastened to the body 132 in any convenient fashion. The cover 126 is intended to enclose the bar 48 and the slits 102 and 104 by engaging the lip 130 behind the plate 124 and by rotating the body 132 to the position shown in FIGS. *7b* and *7c* compressing the gasket 138 between the body 132 and the enclosure 14. This compression protects the handle assembly 10 and the padlock 94 from the elements.

To ensure compression of the gasket 138 and to prevent access to the handle 49, a latch assembly 140 includes a shaft 142 journaled for rotation in side walls 143 of the cavity 136 as by bushing-bearing assemblies 144. Mounted by screws 146 or the like to a flat 148 on the shaft 142 is a flipper 150. The flipper 150 includes a finger-engageable portion 152. As viewed in FIG. 7A, if the portion 152 is engaged and is pulled in a direction out of the plane of the FIGURE (clockwise in FIG. *7b*), the flipper 150 rotates about the axis of the shaft 142 which also rotates. After such rotation, if the flipper 150 is rotated in a direction into the plane of FIG. 7A (counterclockwise in FIG. 7B), the shaft 142 again rotates until a back surface 154 of the flipper 150 abuts a floor 156 of the cavity 136. Keyed to the shaft 142 for rotation therewith is a latch 158. The latch 158 includes an arm portion 160 having a latch indentation 162 formed therein which is contiguous with a cam surface 164. Mounted to the enclosure 14 is a latch bracket 166 which includes a roller 168 rotatably held between two arms 170.

The indentation 162 normally engages the roller 168 when the back surface 154 of the flipper 150 abuts the floor 156 of the cavity 136. Such engagement compresses the gasket 138. If it is desired to gain access to the handle assembly 10, the flipper 150 is pulled out of the cavity 136 via the portion 152, rotating the shaft 142 to disengage the indentation 162 from the roller 168. Following this, the cover 126 may be removed by disengaging the lip 130 from the plate 124. To prevent access to the handle assembly 10, following engagement of the lip 130 and the plate 124, the cover 126 is held against the enclosure 14 and the flipper 150 is pushed into the cavity 136 effecting engagement of the roller 168 by the indentation 162. The cam surface 164 cams the indentation 162 into engagement with the roller 168 in the event the cover 126 is not fully against the enclosure 14 as the flipper 150 is manipulated.

The back surface 154 of the flipper 150 may have a slot 172 formed therethrough behind the portion 152 for passage therethrough of a staple 174 mounted to the floor 156 of the cavity 136. The staple 174 includes a hole 176 therethrough into which a locking member such as the shackle of a padlock 178 may be placed to immobilize the flipper 150. The staple 174 and the lock shackle are thus "hidden" by the portion 152 rendering difficult effective tampering therewith.

Figures 7A, 7B, 7C:
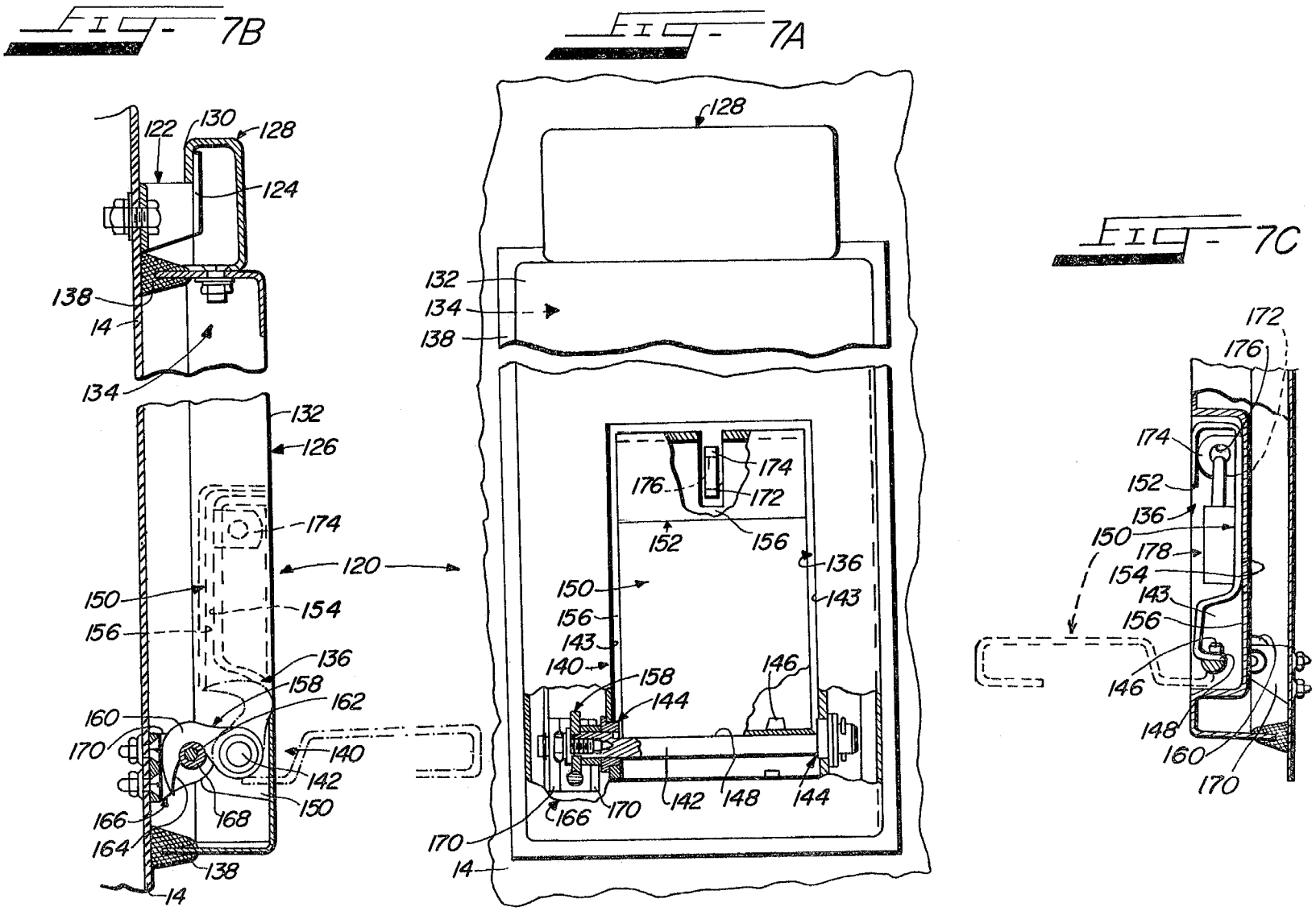
FIGS. 7A–7C show various views of a cover assembly usage with the handle assembly of FIGS. 1–6.

As can be seen in FIGS. 7B and 7C the flipper 150 is normally located entirely within the cavity 136 so that the low profile of the cover 126 is not affected.

Figure 6:
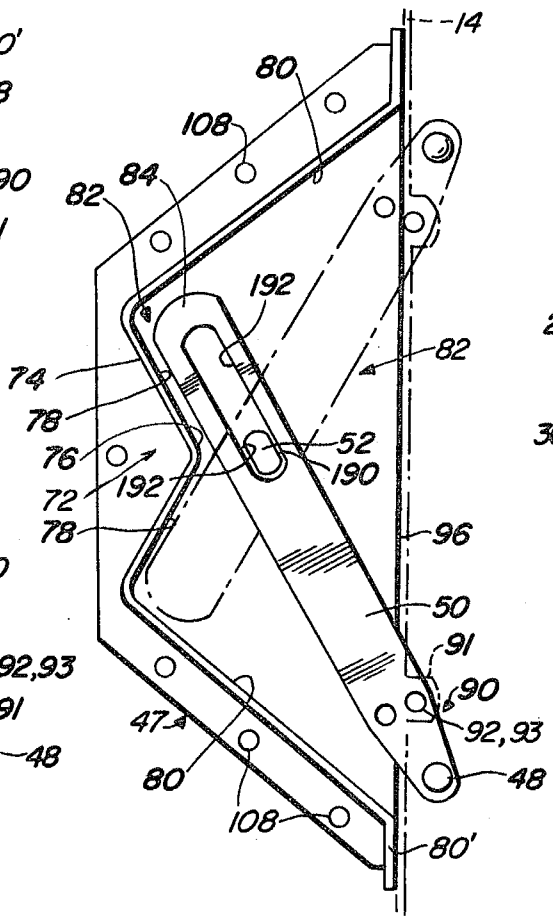
FIGS. 5 and 6 are detailed views of portions of the handle assembly of the present invention illustrating embodiments which are alternative to those depicted in FIGS. 1–3.
Figure 5:
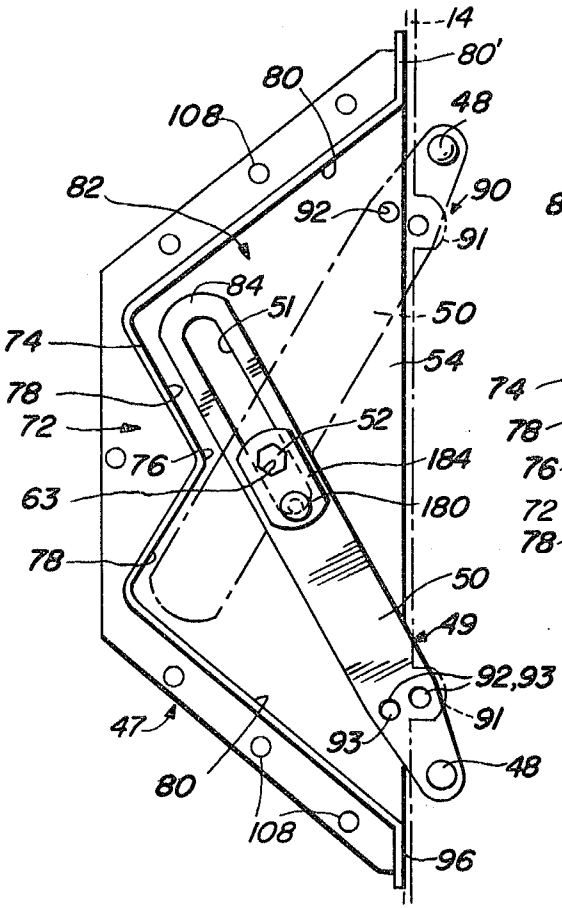

The interactions between the shaft 52 and the slot 51, on the one hand, and the pin 66 and the slots 64, on the other hand, provide a guiding function which maintains the member 50 of the handle 49 at all times generally longitudinally parallel to the arms 60. Other structure for similarly guiding the member 50 relative to the arms 60 may clearly be utilized. For example, as shown in FIG. 5, a pin 180 similar to the pin 66 may be mounted between shortened arms 184 and the slot 64 may be eliminated as may the pin 66. In this event, the pin 180 mounted to the members 184 rides in the slot 51. Moreover, as shown in FIG. 6, the arms 60 may be totally eliminated. In this event, one or more flats 190 may be machined into or otherwise formed on the shaft 52. The member 50 of the handle 49 contains a single, elongated slot 192 similar to the slot 51. The elongated walls of the slot 192 engage at all times the flats 190 formed on the shaft 52. In this way, sliding movement of the handle 49 in and out of the volume 82 of the frame 47 is guided and the handle 49 is coupled to the shaft 52 for rotation of the sprocket 41 to operate the switch 20.

We claim:

1. An assembly for manual operation of apparatus, comprising:

a rotatable shaft;

means on the shaft and rotatable therewith for operating the apparatus in response to the shaft rotation;

rotatable handle means for rotating the shaft;

means for mounting the handle means to the shaft for longitudinal movement toward and away from the shaft between two extreme positions; and control means for preventing rotation of the handle means when the handle means is in one of its extreme longitudinal positions and for permitting rotation of the handle means when the handle means is in its other extreme longitudinal position.

2. The assembly of claim 1, wherein the control means prevents rotation of the handle means when the handle means is between its extreme longitudinal positions.

3. The assembly of claim 1, wherein the handle means is rotatable between two extreme locations when the handle means is in its other extreme longitudinal position, and the control means prevents longitudinal movement of the handle means toward the one extreme longitudinal position when the handle means is between the extreme rotative locations.

4. The assembly of claim 2 or 3, wherein the control means is a cam surface shaped so as to (a) interfere with rotation of the handle means when the handle means is in either of its extreme rotative locations and is simultaneously in its one extreme longitudinal position, and (b) interfere with longitudinal movement of the handle means toward the one extreme longitudinal position when the handle means is between its extreme rotative locations.

5. The assembly of claim 4 for manual operation of the apparatus which resides within an enclosure, wherein in its one extreme longitudinal position, the handle means is substantially within the enclosure and presents a low profile with respect thereto, and in its other extreme longitudinal position the handle means is substantially without the enclosure.

6. The assembly of claim 5, which further comprises:

means for preventing the application of rotative and longitudinal forces to substantially all of the handle means when the handle means is in its one extreme longitudinal position.

7. The assembly of claim 6, which further comprises:

a hand-graspable member on the handle means, the member being without the enclosure in all longitudinal positions and rotative locations of the handle means, the effective lever arm between the member and the shaft when the handle means is in its other extreme longitudinal position being such that only reasonable manual rotative force on the member is required to operate the apparatus.

8. An assembly for manually operating a high-voltage switch, comprising:

an arm;

a rotatable shaft mounting the arm, rotation of the arm rotating the shaft;

means for operating the switch in response to shaft rotation;

a handle slidably mounted to the arm for longitudinal movement toward and away from the shaft between two extreme positions, rotation of the handle about the axis of the shaft rotating the arm; and control means for preventing handle rotation in one of its extreme longitudinal positions and for permitting handle rotation in its other extreme longitudinal position.

9. The handle assembly of claim 8 which further comprises:

a walled frame rotatably mounting the shaft with the arm between walls thereof, the frame permitting rotation of the handle between two extreme locations, and the control means preventing longitudinal handle movement to its one extreme longitudinal position when the handle is between its extreme rotative locations.

10. The handle assembly of claim 9, wherein the handle includes a manually graspable portion at one end thereof, manipulation of the portion effecting the longitudinal movement and the rotation of the handle.

11. The handle assembly of claim 10, wherein the control means comprises:

a contoured member shaped so as to interfere with and prevent the rotation of the other end of the handle when the handle is in either of its extreme rotative locations and in its one extreme longitudinal position, and to interfere with and prevent longitudinal movement of the other end of the handle to the handle's one extreme position when the handle is between its extreme rotative locations.

12. The handle assembly of claim 11, wherein the contoured member is positioned between the opposed frame walls and generally describes a convexity as viewed from the manually graspable portion of the handle.

13. The handle assembly of claim 12, wherein in its one extreme longitudinal position the handle resides substantially within a volume bounded by the opposed frame walls and the contoured member, and in its other extreme longitudinal position the handle resides substantially without the volume.

14. The handle assembly of claim 13, wherein the contoured member includes an apex and surfaces sloping away therefrom, the surfaces interfering with the other end of the handle when the handle is both substantially within the volume and in either of its extreme rotative locations, the apex interfering with the other end of the handle when the handle is both substantially without the volume and between its extreme rotative locations.

15. The handle assembly of claim 14, which further comprises means for guiding longitudinal handle movement so as to prevent relative rotation between the handle and the arm.

16. The handle assembly of claim 15, wherein the guiding means comprises:

a way formed in the arm, and a pin on the handle which slides in the way.

17. The handle assembly of claim 16, wherein the guiding means further comprises:

a way formed in the arm in which way the shaft is positioned.

18. The handle assembly of claim 15, wherein the guiding means comprises:

a way formed in the handle, and a pin on the arm which slides in the way.

19. The handle assembly of claim 15, wherein the guiding means comprises:

a flat formed on the shaft, and a way formed in the handle in which way the shaft's flat is positioned.

20. The handle assembly of claim 9,10,11,12,13 or 14, which further comprises means for locking the handle to the frame only when the handle is in either of its extreme rotative locations and in its one extreme longitudinal position.

21. The handle assembly of claim 20, wherein the locking means comprises:

a pair of tabs on the frame, each tab having a hole therethrough, and a hole through the handle which is aligned with the hole in one or the other of the tabs when the handle is in either of its extreme rotative locations and in its one extreme longitudinal position, a locking member being insertable through the aligned holes to prevent longitudinal movement of the handle out of its one extreme longitudinal position.

22. The handle assembly of claim 8,9,10,11,12,13 or 14, wherein the operating means comprises:

a sprocket on the shaft outside of the frame.

* * * * *